US012714273B2

(12) United States Patent
Fussell

(10) Patent No.: US 12,714,273 B2
(45) Date of Patent: Aug. 25, 2026

(54) CLEANER HEAD

(71) Applicant: Dyson Technology Limited, Wiltshire (GB)

(72) Inventor: Andrew Paul Fussell, Newport (GB)

(73) Assignee: Dyson Technology Limited, Malmesbury (GB)

( * ) Notice: Subject to any disclaimer, the term of this patent is extended or adjusted under 35 U.S.C. 154(b) by 338 days.

(21) Appl. No.: 18/278,655

(22) PCT Filed: Feb. 10, 2022

(86) PCT No.: PCT/GB2022/050356
§ 371 (c)(1),
(2) Date: Aug. 24, 2023

(87) PCT Pub. No.: WO2022/180361
PCT Pub. Date: Sep. 1, 2022

(65) Prior Publication Data

US 2024/0138635 A1 May 2, 2024

(30) Foreign Application Priority Data

Feb. 26, 2021 (GB) ..... 2102781

(51) Int. Cl.
*A47L 9/04* (2006.01)
*A46B 9/02* (2006.01)
(Continued)

(52) U.S. Cl.
CPC ..... *A47L 9/0477* (2013.01); *A46B 9/025* (2013.01); *A46B 9/026* (2013.01); *A46B 13/006* (2013.01);
(Continued)

(58) Field of Classification Search
CPC .... A47L 9/0477; A47L 9/0411; A47L 9/0466; A47L 9/04
See application file for complete search history.

(56) References Cited

U.S. PATENT DOCUMENTS 500,415 A 6/1893 Neal
1,708,194 A 4/1929 Smidley
(Continued)

FOREIGN PATENT DOCUMENTS

CN 111012241 A 4/2020
DE 102007006654 A1 8/2008
(Continued)

OTHER PUBLICATIONS

International Search Report and Written Opinion received for PCT Patent Application No. PCT/GB2022/050355, mailed on May 20, 2022, 9 pages.
(Continued)

*Primary Examiner* — Bryan R Muller
(74) *Attorney, Agent, or Firm* — Tucker Ellis LLP

(57) ABSTRACT

A cleaner head for a vacuum cleaner, the cleaner head being configured to apply suction to a horizontal surface to be cleaned by the vacuum cleaner. The cleaner head includes: first and second agitator elements each being mounted for rotation about a respective axis. Each agitator element includes a first, free end and a second end, each agitator element has a shape which tapers towards the first end in a direction along the axis of rotation, the first and second agitator elements are cantilevered from opposing sides of a hub portion of the cleaner head at their respective second ends, and each agitator element is arranged such that when the cleaner head is applying suction to the horizontal sur-
(Continued)

face, the position of the axis at the first end of the element is closer to the surface than the position of the axis at the second end of the element.

14 Claims, 9 Drawing Sheets

(51) Int. Cl.
*A46B 13/00* (2006.01)
*A46B 13/02* (2006.01)

(52) U.S. Cl.
CPC ..... *A46B 13/02* (2013.01); *A47L 9/0411* (2013.01); *A47L 9/0427* (2013.01); *A46B 2200/3033* (2013.01)

(56) References Cited

U.S. PATENT DOCUMENTS

| | | | | |
|---|---|---|---|---|
| 4,653,137 | A | 3/1987 | Fleischhauer | |
| 11,039,722 | B2 * | 6/2021 | Brown | A47L 9/2857 |
| 11,826,009 | B2 * | 11/2023 | Williamson | A47L 9/0444 |
| 12,029,376 | B2 * | 7/2024 | Tsuchida | A47L 9/0433 |
| 2010/0107357 | A1 * | 5/2010 | Odachi | A47L 9/0411 15/389 |
| 2016/0174790 | A1 | 6/2016 | Kim et al. | |
| 2021/0386257 | A1 | 12/2021 | Rwekmper | |
| 2022/0079402 | A1 | 3/2022 | Isaacs | |

FOREIGN PATENT DOCUMENTS

| | | | | |
|---|---|---|---|---|
| DE | 102011053667 | A1 * | 3/2013 | A47L 9/0433 |
| DE | 202019101044 | U1 | 5/2020 | |
| EP | 3031374 | A1 | 6/2016 | |
| EP | 3766398 | A1 | 1/2021 | |
| GB | 1067851 | A | 5/1967 | |
| GB | 2569313 | A | 6/2019 | |
| GB | 2584446 | A | 12/2020 | |
| JP | 62-207424 | A | 9/1987 | |
| JP | 2018-086610 | A | 6/2018 | |
| WO | 2016/028243 | A1 | 2/2016 | |

OTHER PUBLICATIONS

International Search Report and Written Opinion received for PCT Patent Application No. PCT/GB2022/050356, mailed on May 13, 2022, 11 pages.
International Search Report and Written Opinion received for PCT Patent Application No. PCT/GB2022/050357, mailed on May 23, 2022, 9 pages.
Search Report received for GB Application No. 2102779.2, mailed on Jul. 14, 2021, 1 page.
Search Report received for GB Application No. 2102780.0, mailed on Jul. 15, 2021, 1 page.
Search Report received for GB Application No. 2102781.8, mailed on Jul. 15, 2021, 1 page.

* cited by examiner

CLEANER HEAD

CROSS-REFERENCE TO PRIOR APPLICATION

This application is a § 371 National Stage Application of PCT International Application No. PCT/GB2022/050356 filed Feb. 10, 2022, which claims the priority of United Kingdom Application No. 2102781.8, filed Feb. 26, 2021, each of which are herein incorporated by reference in their entirety.

TECHNICAL FIELD

The present disclosure relates to a cleaner head for a vacuum cleaner. The present disclosure also relates to a vacuum cleaner comprising the cleaner head.

BACKGROUND

A vacuum cleaner typically comprises a main body containing a dirt and dust separating apparatus, a cleaner head connected to the main body and having a suction opening, and a motor-driven fan unit for drawing dirt-bearing air through the opening and the cleaner head, and into the main body of the vacuum cleaner. The suction opening is directed downward to face the floor surface to be cleaned. The dirt-bearing air is conveyed to the separating apparatus so that dirt and dust can be separated from the air before the air is expelled to the atmosphere. The separating apparatus can include one or more of a filter, a filter bag and a cyclonic arrangement.

A driven agitator may be mounted for rotation within a suction cavity of the cleaner head. Rotation of the agitator may be driven by an electric motor powered by a power supply derived from the main body of the vacuum cleaner. The agitator sweeps dust rearward through the suction opening of the cleaner head.

It is an object of the present disclosure to provide an improved cleaner head for a vacuum cleaner.

SUMMARY

According to a first aspect of the present disclosure, there is provided a cleaner head for a vacuum cleaner. The cleaner head is configured to apply suction to a horizontal surface to be cleaned by the vacuum cleaner. The cleaner head comprises first and second agitator elements, each being mounted for rotation about a respective axis. Each agitator element comprises a first, free end and a second end. Each agitator element has a shape which tapers towards the first end in a direction along the axis of rotation. The first and second agitator elements are cantilevered from opposing sides of a hub portion of the cleaner head at their respective second ends. Each agitator element is arranged such that when the cleaner head is applying suction to the horizontal surface, the position of the axis at the first end of the element is closer to the surface than the position of the axis at the second end of the element.

In an embodiment, by arranging the agitator elements such that the position of the axis at the first end (the free end) of each element is closer to the surface to be cleaned than the position of the axis at the second end (e.g. the opposite end) of each element, the agitator elements are effectively angled downwards, towards the surface to be cleaned by the vacuum cleaner and away from a top housing portion of the cleaner head. In this manner, the tapered profile of the agitator elements, which may be generally frusto-conical in shape, is at least partially compensated for. As such, a larger portion of the outer surface of each agitator element will be in contact the surface during use. Furthermore, by angling the tapered agitator elements downwards in this manner, a gap which would otherwise likely be present between the lowermost portions of the two agitator elements at their second ends is reduced in size. This means that a larger region of the surface between the agitator elements is agitated by the cleaner head, and preferably such that there is a unitary region of contact/agitation between the surface to be cleaned and the two agitator elements (e.g. no gap between the respective regions agitated by the two agitator elements of the cleaner head). In embodiments, the axes of the agitator elements may be considered as being canted downwards.

In embodiments, the lowermost portion of the external surface of each agitator element is parallel to the horizontal surface when the cleaner head is applying suction thereto. In this manner, in use the lowermost surface each agitator element cab be fully in contact with the surface being cleaned along its whole length. The angle at which the tapered external surface of each agitator element tapers may be equal to the angle by which the axis of the agitator element is angled downwards (optionally, within +/−20%, say—or possibly within +/−10%). The angle at which the tapered external surface of each agitator element tapers may be less than 45 degrees and may be within the range of 10 degrees to 30 degrees. The angle by which the axis of the agitator element is angled downwards may be less than 45 degrees and may be within the range of 10 degrees to 30 degrees.

In embodiments, the cleaner head further comprises a sole plate in which a suction opening is formed. It may be that the lowermost portion of the external surface of each agitator element is parallel to the sole plate. The cleaner head may be configured such that, in use, the sole plate is typically maintained parallel to the surface to be cleaned.

In embodiments, the uppermost portions of the second ends of the agitator elements are spaced apart, and the lowermost portions of the second ends of the agitator elements are directly adjacent to each other.

In embodiments, the lowermost portions of the second ends of the agitator elements are touching. In this manner, a gap which would otherwise exist between the lower part of the two agitator elements at their second ends is eliminated, such that there is no part of the surface in the region between the agitator elements which is not agitated by the cleaner head.

In embodiments, the external surfaces of the agitator elements comprise a felt-like covering. The felt-like covering may comprise an arrangement of many fine tufts standing on end, which may for example have a fluffy texture or appearance.

In embodiments, external surfaces of the agitator elements comprise bristles, for example upstanding bristles arranged around the agitator elements, which may be in the form of helical strips of bristles.

In embodiments, the external surfaces of the agitator elements comprise an absorbent material such as sponge. Such agitator elements may be arranged to function as mop pads to absorb spilled liquids and/or to perform wet cleaning of a hard floor surface.

The agitator elements may have the same overall shape. The agitator elements may be symmetrically shaped. The agitator elements may be symmetrically arranged.

In embodiments, the cleaner head further comprises a drive for driving rotation of the agitator elements. The drive may comprise first and second motors, the first motor being arranged to drive rotation of the first agitator element, and the second motor being arranged to drive rotation of the second agitator element.

In embodiments, each motor is disposed at least partially within the core of its respective agitator element. This provides for a compact arrangement.

In embodiments, the first and second motors are arranged back-to-back and counter rotating, such that in use the first and second agitator elements rotate in the same direction.

In embodiments, the drive further comprises first and second gears (e.g. reduction gears) arranged to change (e.g. reduce) the output speeds of the first and second motors respectively, the first and second gears being disposed within the cores the first and second agitator elements respectively.

In embodiments, the drive comprises a single motor arranged to drive rotation of both the first and second agitator elements via respective first and second transmissions. Such transmissions may be at least partly disposed within the cores the first and second agitator elements respectively.

In embodiments, each agitator element is arranged such that the position of the axis at the first end of each agitator element is further forwards than the position of the axis at the second end of each agitator element. In an embodiment, by arranging the agitator elements such that the position of the axis at the first end of each agitator element is further forwards than the position of the axis at the second end of each agitator element, the agitator elements are effectively angled forwards, towards the front of the cleaner head and away from the rear of the cleaner head where the outlet is located. It will be appreciated that many cleaner heads have a clearly defined front and rear and that the forward direction will be understood as such in that context. It may for example be that the forward direction corresponds to the direction in which a forward stroke would be performed when using the vacuum cleaner to which the cleaner head is attached. The forward direction may alternatively or additionally be defined as the direction that is apparent if one considers that the region in which suction is applied is rearward of the agitator elements typically. The forward direction may alternatively or additionally be defined as the direction that is apparent if one considers that the agitator elements of this disclosure typically cause dirt and debris to be displaced in a rearward direction from the horizontal surface to be cleaned. The forward direction may be defined in relation to the orientation of the cleaner head when cleaning a horizontal surface. The forward direction may be parallel to such a horizontal surface. In embodiments, the axes of the agitator elements may be considered as being canted forwards.

The angle at which the tapered external surface of each agitator element tapers may be equal to the angle by which the axis of the agitator element is angled forwards (optionally, within +/−20%, say—or possibly within +/−10%). The angle by which the axis of the agitator element is angled forwards may be less than 45 degrees and may be within the range of 10 degrees to 30 degrees.

In embodiments, in which the axes of the agitator elements are angled forwards as described above, the tapered profile of the agitator elements, which may be generally frusto-conical in shape, is at least partially compensated for. Therefore, when the cleaner head is pushed up against an obstacle, such as a wall or skirting board, an unagitated region of the surface to be cleaned near the first ends of the agitator elements may be reduced or possibly eliminated. The configuration is preferably such that, in the case when the cleaner head is pushed up against an obstacle having a vertical flat surface which is directly in front of and facing towards the cleaner head (e.g. such that the second ends of each agitator element are the same distance away from the vertical surface, when the agitator elements are symmetrically shaped and symmetrically arranged), there is a unitary region of contact/agitation between the vertical surface and the two agitator elements (e.g. no gap between the respective regions agitated by the two agitator elements of the cleaner head).

In embodiments, the frontmost portions of the external surfaces of both agitator elements lie in a single plane perpendicular to the horizontal surface when the cleaner head is applying suction thereto. In this manner, when the cleaner head is pushed up against an obstacle, such as a wall or skirting board, an unagitated region of the surface near the first ends of the agitator elements is eliminated.

According to a second aspect of the present disclosure, there is provided a vacuum cleaner comprising a cleaner head according to the first aspect.

It should be appreciated that features described in relation to one aspect of the present disclosure may be incorporated into other aspects of the present disclosure.

DESCRIPTION OF THE DRAWINGS

Embodiments of the present disclosure will now be described by way of example only with reference to the accompanying schematic drawings of which.

DETAILED DESCRIPTION

Figure 1:
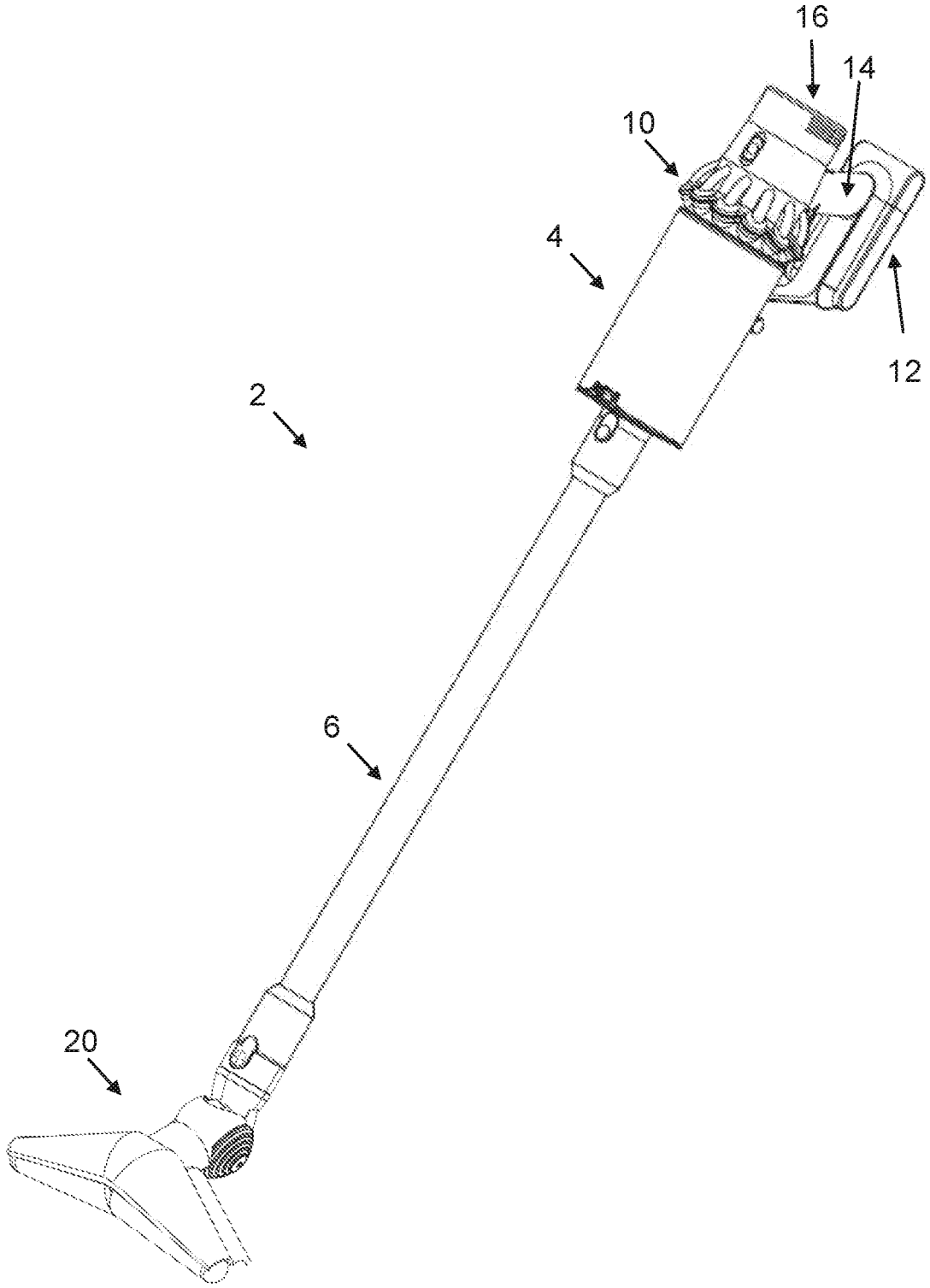
FIG. 1 is a perspective view of a handheld vacuum cleaner.

FIG. 1 shows a hand-held vacuum cleaner 2 according to an embodiment of the disclosure and comprising a main body 4, a wand 6 and a cleaner head 20. The main body 4 comprises a separating system 10, in the form of a cyclonic separator, a motor and impeller (not visible) arranged to draw air through the separating system 10, and a power supply 12, in the form of a battery, for powering the motor. The main body 4 has a handle 14 which is gripped by a user, and a clean air outlet 16 through which air that has passed through the separating system 10 is discharged. The wand 6 is attached at one end to the main body 4 and at the other end to the cleaner head 20. The wand 6 provides fluid communication between the cleaner head 20 and the separating system 10, and supports the cleaner head 20 during use.

Figure 2:
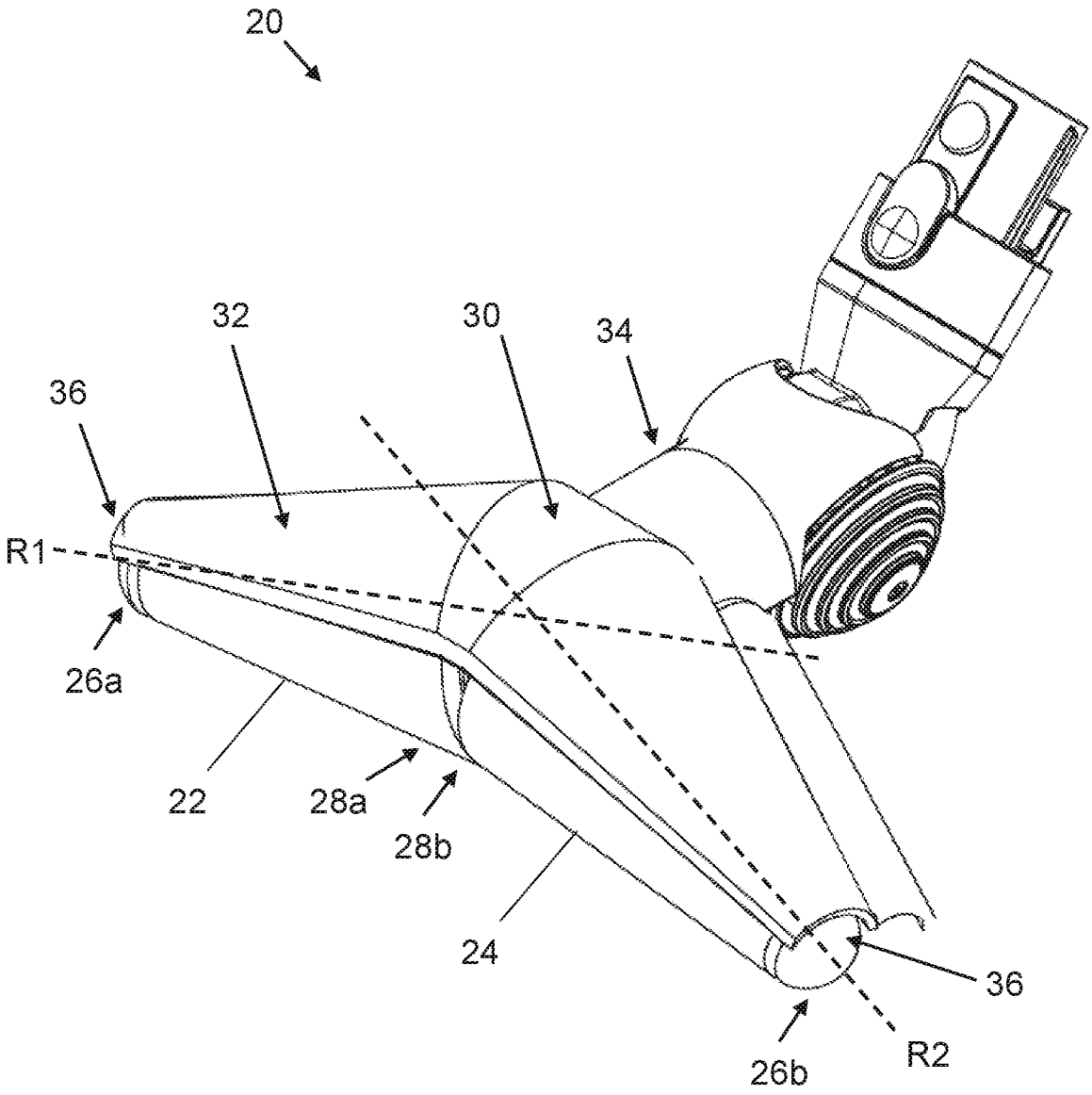
FIG. 2 is a perspective view of the cleaner head of the vacuum cleaner shown in FIG. 1.

FIG. 2 shows a cleaner head 20 according to embodiments of the disclosure. The cleaner head 20 comprises a first agitator element 22 and a second agitator element 24. The first and second agitator elements 22, 24 are each mounted for rotation about respective axes R1, R2. Each agitator element 22, 24 comprises a first, free end 26*a*, 26*b* and a second end 28*a*, 28*b* at which they are mounted to the cleaner head 20. Each agitator element has a shape which tapers towards the first end 26*a*, 26*b* in a direction along the axis of rotation R1, R2. In the illustrated embodiment, the agitator elements 22, 24 are generally frusto-conical in shape. However, it should be appreciated that a portion of one or both agitator elements 22, 24 may not be tapered. For example the shape of one or both agitator elements 22, 24 may consist of a cylindrical portion combined with a frusto-conical portion. The first and second agitator elements 22, 24 are cantilevered from opposing sides of a hub portion of the cleaner head 20 at their respective second ends 28*a*, 28*b*. In the illustrated embodiment, the hub portion 30 is at a laterally central position with respect to the overall cleaner head 20, although this may not always be the case. For example, if the first and second agitator elements 22, 24 have different lengths, then the hub portion 30 could be offset laterally relative to the laterally central part of the cleaner head 20. The cleaner head 20 has a housing 32, which at least partially defines a suction chamber comprising an outlet 34 for expulsion of air and debris towards the vacuum cleaner 2. The suction chamber is delimited at the front by the agitator elements 22, 24. The housing 32 comprises side openings 36, adjacent the first end 26*a*, 26*b* of each agitator element 22, 24. The functions of these side openings 36 are described below. The external surfaces of the agitator elements comprise a felt-like covering with, in some embodiments, upstanding helical strips of bristles.

Figure 3:
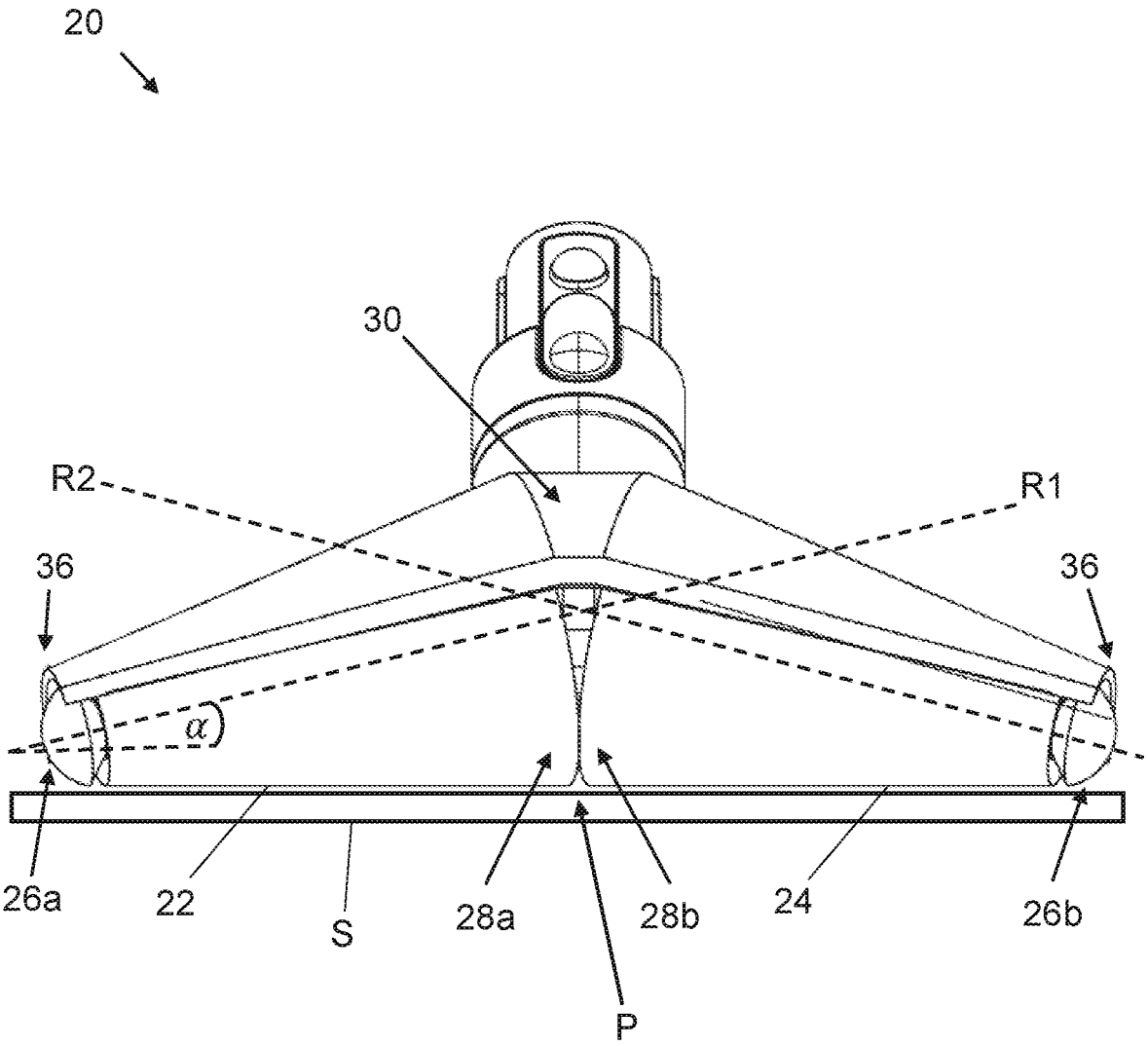
FIG. 3 is a front view of the cleaner head shown in FIG. 2.

As is most clearly illustrated in FIG. 3, which is a front view of the cleaner head 20, each agitator element 22, 24 is arranged such that when the cleaner head 20 is applying suction to the horizontal surface S to be cleaned (e.g. hard flooring), the position of the axis R1, R2 at the first end 26*a*, 26*b* of each agitator element 22, 24 is closer to the surface S than the position of the axis R1, R2 at the second end 28*a*, 28*b* of each agitator element 22, 24. Therefore the agitator elements 22, 24 are effectively angled downwards (e.g. canted downwards), towards the surface S to be cleaned by the vacuum cleaner 2. In FIG. 3, the axes R1, R2 of both agitator elements 22, 24 are angled downwards by the same angle α. In this way, the tapered profile of the agitator elements 22, 24, which in the illustrated embodiment are frusto-conical in shape, is at least partially compensated for, such that regions of the surface S proximate the first ends 26*a*, 26*b* of the agitator elements 22, 24 are agitated. Furthermore, by angling the tapered agitator elements 22, 24 downwards, a gap which would otherwise exist between the lowermost portions of the two agitator elements 22, 24 at their respective second ends 28*a*, 28*b* (i.e. in the region marked "P" in FIG. 3) is reduced is size, such that a larger region of the surface S between the two agitator elements 22, 24 is effectively agitated by the cleaner head 20.

In the illustrated embodiment, the downwards angling of the agitator elements 22, 24 is such that the lowermost portion of the external surface of each agitator element 22, 24 is parallel to the horizontal surface S when the cleaner head 20 is applying suction thereto. Furthermore, there is substantially no gap between the lowermost portions of the agitator elements 22, 24 at their second ends 28*a*, 28*b*, i.e. the lowermost portions of the agitator elements 22, 24 are in contact at their second ends 28*a*, 28*b*. This means that there is very little, if any, unagitated region of the surface S between the two agitator elements 22, 24 (i.e. in the region marked "P" in FIG. 3). In this embodiment the respective regions on the floor agitated by the two agitator elements touch each other so that there is effectively a single unitary (elongate) region agitated by the cleaner head on the floor at any given time. In general, this condition (the lowermost portions of the agitator elements being parallel to the floor) will be achieved when the agitator elements 22, 24 are angled downwards by an angle α which is equal to half the cone angle of the frusto-conical agitator elements 22, 24. The tapering of the conical shape of the external surface of each agitator element has a taper angle which is equal to half the cone angle and thus in the illustrated embodiment the same as the angle α by which the axis of the agitator element is angled downwards. In this embodiment that angle α is about 15 degrees. Given that the external surface of each agitator element may have some resilience/deformability and that surfaces to be cleaned in practice are rarely perfectly flat, it will be appreciated that the lowermost portion need not be exactly parallel, in the strict mathematical sense, to the horizontal surface for the agitator element to cause agitation of the surface to be cleaned along substantially the entire length of the external surface of the element arranged to perform such agitating.

Figure 4A:
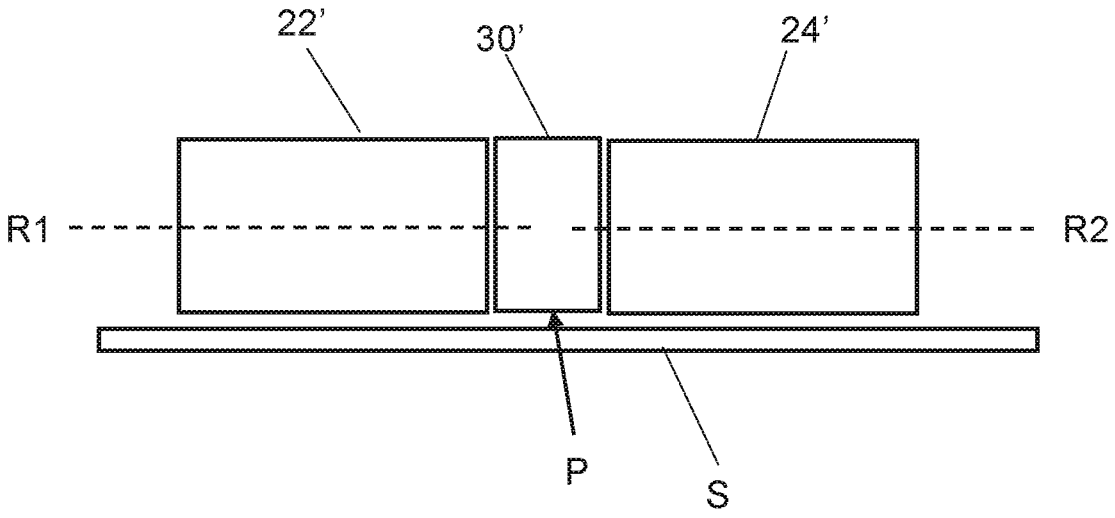
FIGS. 4*a*, 4*b* show a comparison between cantilevered non-tapered agitators and the cantilevered agitators of the cleaner head shown in FIG. 2.
Figure 4B:
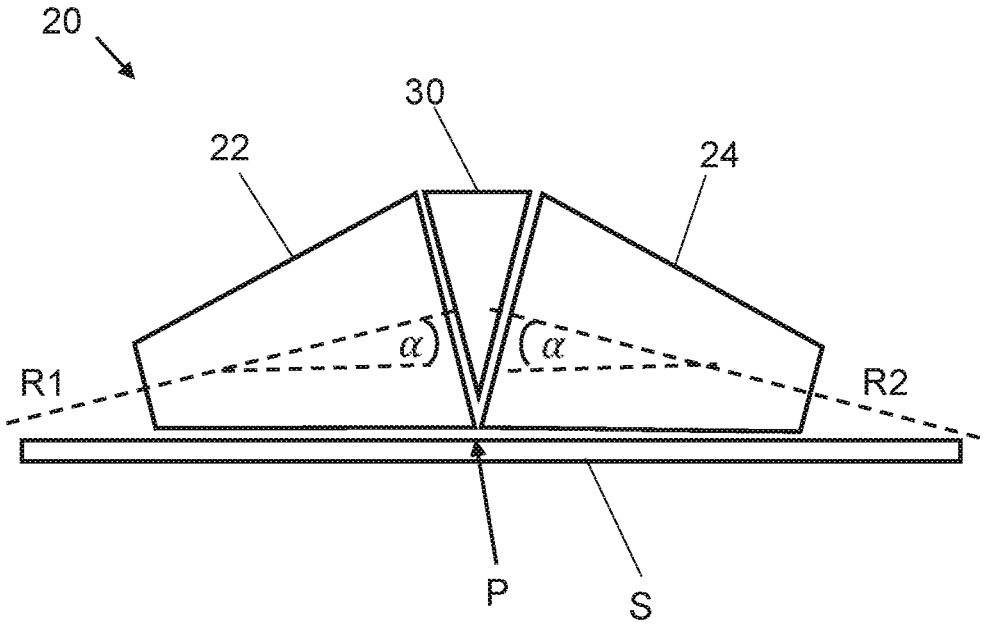

FIGS. 4*a* and 4*b* illustrate reducing the gap between the lowermost portions of the agitator elements 22, 24 at their second ends 28*a*, 28*b* (i.e. in the region marked "P" in FIG. 3). FIG. 4*a* shows a front view of a cleaner head, comprising a pair of cylindrical (i.e. not tapered) agitator elements 22', 24' which are cantilevered from a hub 30'. Due to the presence of the hub 30', there is a region P of the surface S underneath the hub 30' which is not agitated by either of the agitator elements 22', 24'. FIG. 4*b* is a simplified version of FIG. 3, and shows a front view of a cleaner head 20 according to embodiments of the disclosure (i.e. having tapered agitator elements). Due to the tapered form of the agitator elements 22, 24 and the downward angling of the elements 22, 24 by angle α, it should be noted that there is a much smaller region P of the surface S underneath the hub 30 which is not agitated. Indeed, there may effectively be no unagitated region at all.

Figure 5:
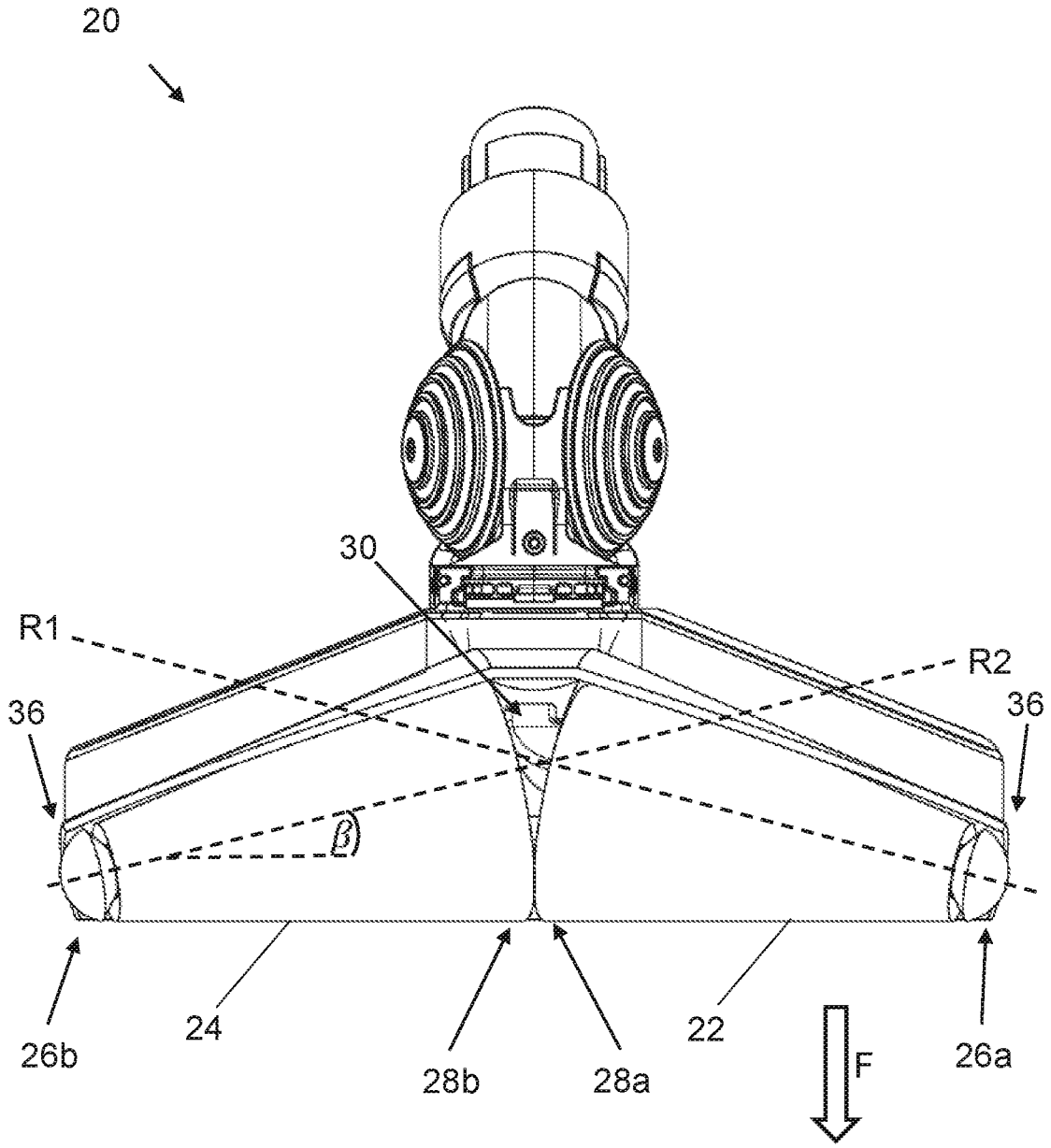
FIG. 5 is an underside view of the cleaner head shown in FIG. 2.

FIG. 5, which is an underside view of the cleaner head 20, illustrates how in embodiments each agitator element 22, 24 is arranged such that the position of the axis R1, R2 at the first end 26*a*, 26*b* of each agitator element 22, 24 is further forwards than the position of the axis R1, R2 at the second end 28*a*, 28*b* of each agitator element 22, 24. Therefore, the agitator elements 22, 24 are effectively angled forwards, towards the front of the cleaner head 20 and away from the outlet 34, i.e. they are angled in a direction corresponding to a forward cleaning stroke being performed using the vacuum cleaner 2 to which the cleaner head 20 is attached. The forward direction is shown in FIG. 5 by an arrow F. In this manner, the tapered profile of the agitator elements 22, 24, which in the illustrated embodiment are frusto-conical in shape, is at least partially compensated for, as described below.

In the embodiment of FIG. 5, the axes R1, R2 of both agitator elements 22, 24 are angled forwards by the same angle β, such that the frontmost portions of the external surfaces of both agitator elements 22, 24 lie in a single plane perpendicular to the horizontal surface S when the cleaner head 20 is applying suction thereto. As such, when the cleaner head 20 is pushed up against an object, such as a wall or skirting board, the unagitated regions of the surface S near the first ends 26*a*, 26*b* of the agitator elements 22, 24 are reduced. In certain embodiments, the unagitated regions of the surface S near the first ends 26*a*, 26*b* of the agitator elements 22, 24 may be minimised. This particular condition will be achieved when the agitator elements 22, 24 are angled forwards by an angle β equal to half the cone angle of the frusto-conical agitator elements 22, 24. The free ends (the first ends) 26*a*, 26*b* of the frusto-conical agitator elements 22, 24 may then both be as close to the wall as possible, leaving very little if any unagitated regions of the surface S near the wall. Such an arrangement may be useful if agitation of a vertical surface is required, for example when cleaning stairs, as there may be an uninterrupted line of contact with the vertical surface from the free end 26*a* of one element to the free end 26*b* of the other agitator element. The tapering of the conical shape of the external surface of each agitator element has a taper angle which is the same as the angle β by which the axis of the agitator element is angled forwards. In this embodiment that angle β is about 15 degrees.

Figure 6A:
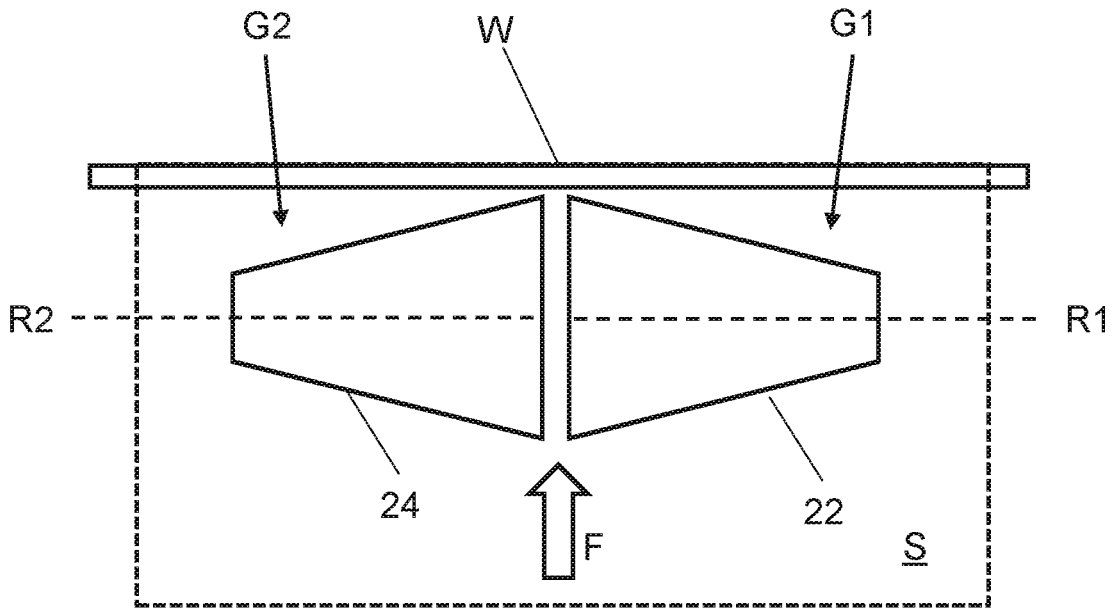
FIGS. 6*a*, 6*b* show simplified top-down views of cleaner heads having cantilevered agitators with and without forwards angling of the agitator elements.
Figure 6B:
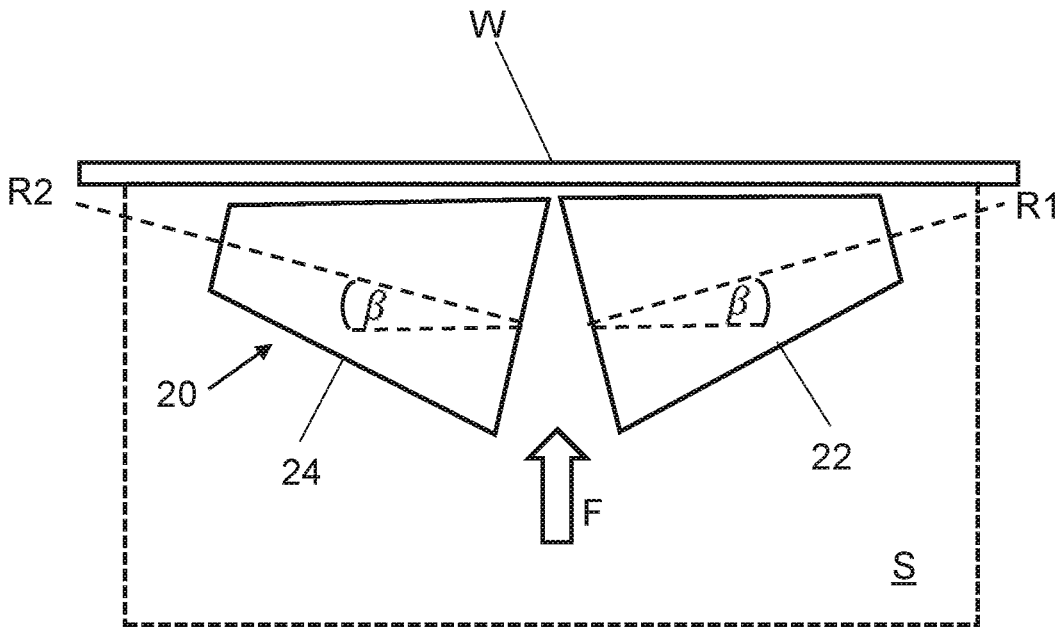
Figure 7:
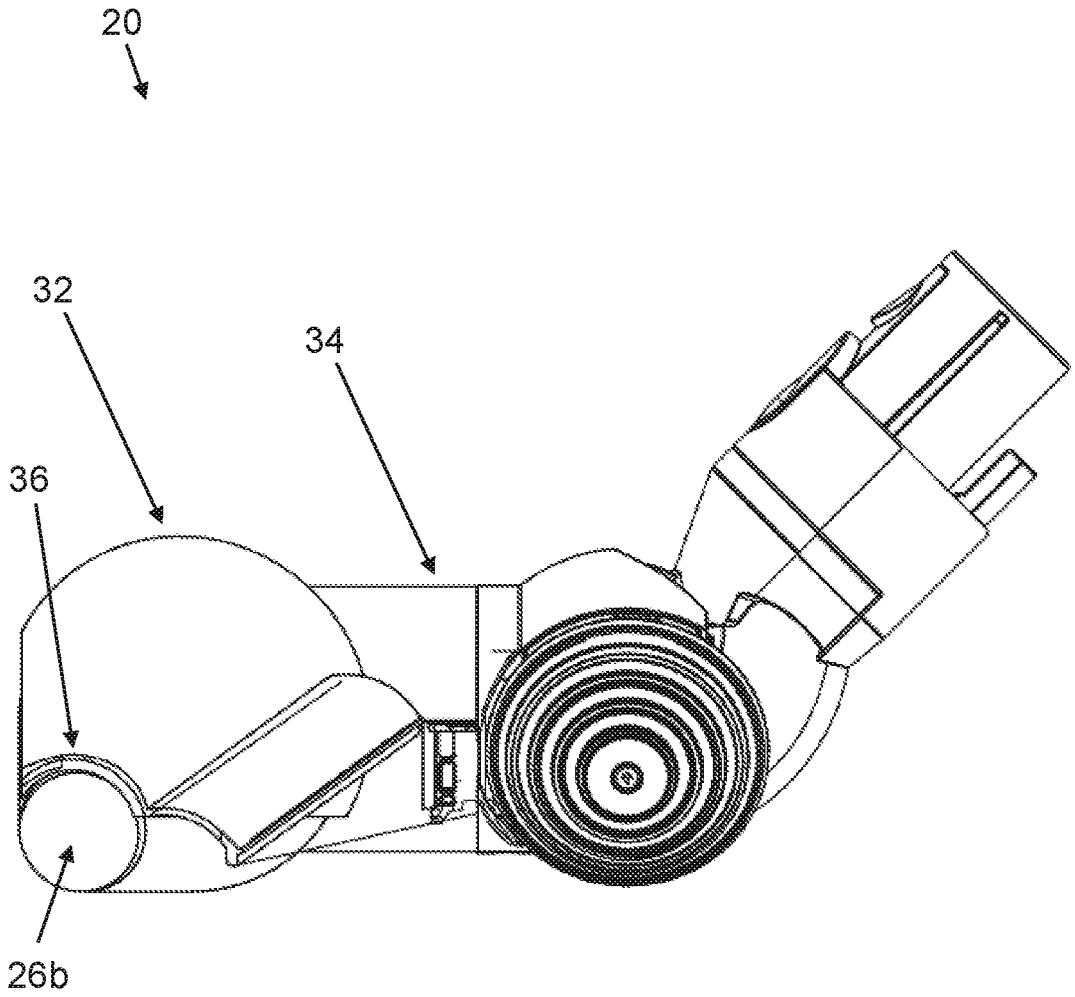
FIG. 7 is a side view of the cleaner head shown in FIG. 2.

This effect is more clearly illustrated with reference to FIGS. 6*a* and 6*b*. FIG. 6*a* shows a simplified top-down view of a cleaner head 20, where each agitator element 22, 24 is arranged such that the position of the axis R1, R2 at the first end 26*a*, 26*b* of each agitator element 22, 24 is no further forwards than the position of the axis R1, R2 at the second end 28*a*, 28*b* of each agitator element 22, 24. As such, when the cleaner head is moved up against an object W, such as a wall or skirting board, the frontmost portions of the agitator elements 22, 24 contact the object W, leaving gaps G1, G2 either side in which the surface S cannot be agitated without repositioning the cleaner head to approach from a different angle, e.g. different from the forward facing direction F being perpendicular to the plane of the object W. FIG. 6*b* is a simplified top-down view of the cleaner head 20 shown in FIG. 5, where the axes R1, R2 of both agitator elements 22, 24 are angled forwards by the same angle β, such that the frontmost portions of the external surfaces of both agitator elements 22, 24 lie in a single plane perpendicular to the horizontal surface S when the cleaner head is applying suction thereto. As such, when the cleaner head 20 is pushed up against the object W, the unagitated regions G1, G2 of the surface S near the first ends 26*a*, 26*b* of the agitator elements 22, 24 are minimised. Given that the external surface of each agitator element may have some resilience/deformability and that walls, skirting boards and the like are rarely perfectly flat and vertical, it will be appreciated that the frontmost portions of the external surfaces of both agitator elements need not be exactly straight and need not lie completely within a single plane, in the strict mathematical sense, in order for the agitator elements to get sufficiently close to the wall or skirting board to provide the advantage mentioned above.

It should be appreciated that in some embodiments, the agitator elements may be angled downwards but not forwards, whereas in other embodiments, the agitator elements may be angled forwards but not downwards. Furthermore, it should be appreciated that the agitator elements may not necessarily be angled downwards by an angle corresponding to half the cone angle of the agitator elements and the agitator elements may not necessarily be angled forwards by an angle corresponding to half the cone angle of the agitator elements. In embodiments, the agitator elements may have different lengths and/or different cone angles. Accordingly, the first and second agitator elements may be angled forwards and/or downwards by different angles. In some embodiments, the cleaner head 20 comprises a sole plate in which a suction opening is formed. The lowermost portion of the external surface of each agitator element may be parallel to the sole plate and/or the frontmost portions of the external surfaces of both agitator elements may lie in a single plane perpendicular to the plane of the sole plate.

Figure 8:
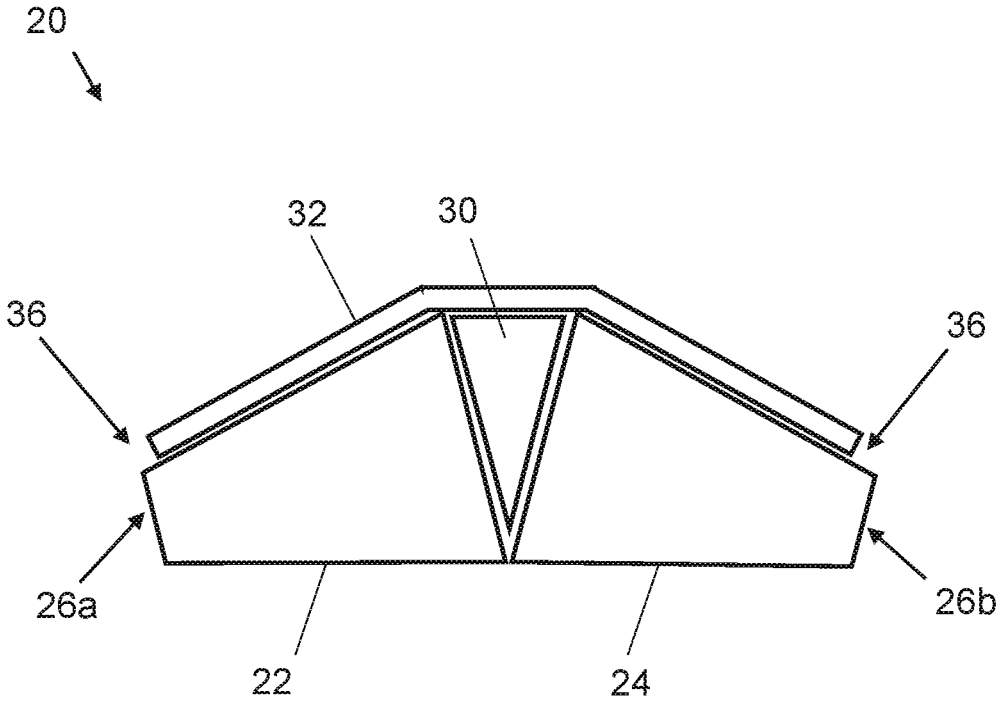
FIG. 8 is a front view of a cleaner head in which the agitator elements project through side openings in the cleaner head housing.

Cleaner heads 20 according to embodiments of the disclosure have a cleaner head housing 32 comprising side openings 36 adjacent the first end 26*a*, 26*b* of each agitator element 22, 24. These side openings 36 are visible in FIGS. 2, 3 5 and 7. The side openings 36 provide two separate functions. Firstly, in embodiments they provide a suction path from the first ends 26*a*, 26*b* of the agitator elements 22, 24 towards the cleaner head outlet 34. In this manner, debris, such as hair, which migrates towards the first ends 26*a*, 26*b* of the tapered agitator elements 22, 24, potentially falling off the first ends completely, can be sucked up by the vacuum cleaner 2. Secondly, in embodiments, the first ends 26*a*, 26*b* of the agitator elements 22, 24 can project into or through the side openings 36. This enables the first ends 26*a*, 26*b* of the agitator elements 22, 24 to protrude beyond the footprint of the cleaner head housing 32, providing for a greater agitation width and up to the edge cleaning. FIG. 8 illustrates schematically a front view of a cleaner head 20 in which the first ends 26*a*, 26*b* of the agitator elements 22, 24 project through the side openings 36, such that the first end of each the agitator element protrudes beyond the footprint of the cleaner head housing 32.

It should be appreciated that in embodiments, the side openings 36 may provide only one of these two functions. For example, the side opening 36 may provide a suction path in the manner described, but the first ends 26*a*, 26*b* of the agitator elements may not project into or through the side opening 36. Alternatively, the first end 26*a*, 26*b* of the agitator elements 22, 24 may project into or through the side opening 36, but the first end 26*a*, 26*b* may be sized such that it substantially fills the side opening 36, thereby delimiting the suction chamber. In this manner, no such suction path is provided. It should also be appreciated that in cleaner heads according to some embodiments, only one agitator element may be provided, whilst still benefiting from the advantages provided by the side opening 36 in the cleaner head housing 32.

Figure 9A:
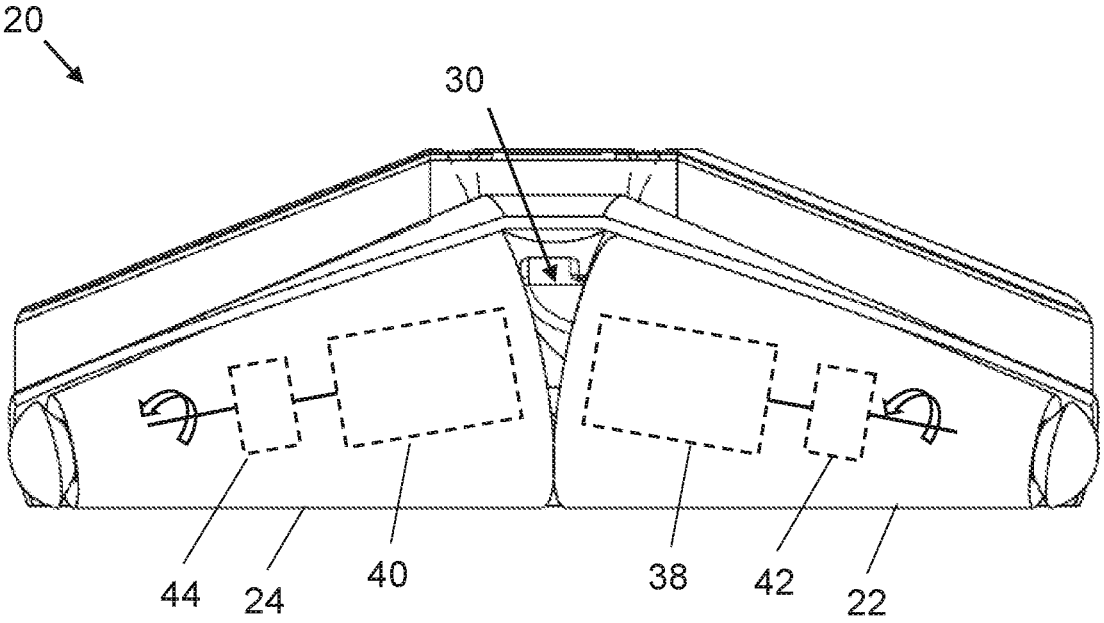
FIGS. 9*a*, 9*b* are cutaway underside views of the cleaner head shown in FIG. 2.
Figure 9B:
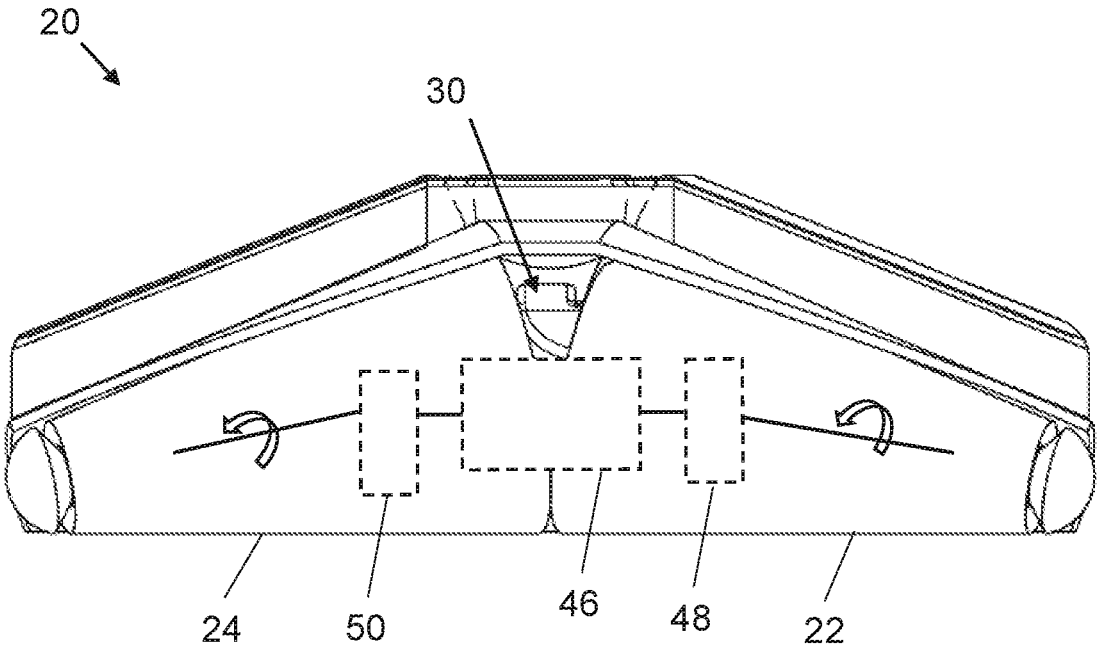

With reference to FIGS. 9*a* and 9*b*, which show the cleaner head 20 from the underside, the cleaner head 20 further comprises a drive for driving rotation of the agitator elements 22, 24. In the embodiment of FIG. 9*a*, the drive comprises a first motor 38 arranged to drive rotation of the first agitator element 22 and a second motor 40 arranged to drive rotation of the second 24 agitator element. Each motor is disposed (at least partially) within the core of its respective agitator element 22, 24. It should be appreciated that the motors can be accommodated fully within the agitator cores or may project slightly outward towards the hub 30 region between the two cantilevered agitator elements 22, 24. The first and second motors 38, 40 are arranged back-to-back and are therefore arranged to be counter rotating (i.e. the output shaft of one motor rotates clockwise whilst the output shaft of the other motor rotates counter clockwise), such that in use the first and second agitator elements 22, 24 rotate in the same direction. In the illustrated embodiment, the drive further comprises first and second gears 42, 44 (e.g. reduction gears) arranged to change (e.g. reduce) the output speeds of the first and second motors 38, 40 respectively. As with the motors 38, 40, the gears 42, 44 are disposed (at least partially) within the cores of their respective agitator elements 22, 24. In the embodiment of FIG. 9*b*, the drive comprises a single motor 46 arranged to drive rotation of both the first and second agitator elements 22, 24 via respective first and second transmissions 48, 50.

Where in the foregoing description, integers or elements are mentioned which have known, obvious or foreseeable equivalents, then such equivalents are herein incorporated as if individually set forth. Reference should be made to the claims for determining the true scope of the present disclosure, which should be construed so as to encompass any such equivalents. It will also be appreciated by the reader that integers or features of the present disclosure that are described as preferable, advantageous, convenient or the like are optional and do not limit the scope of the independent claims. Moreover, it is to be understood that such optional integers or features, whilst of possible benefit in some embodiments of the present disclosure, may not be desirable, and may therefore be absent, in other embodiments.

The invention claimed is:

1. A cleaner head for a vacuum cleaner, the cleaner head being configured to apply suction to a horizontal surface to be cleaned by the vacuum cleaner, wherein the cleaner head comprises:

first and second agitator elements each being mounted for rotation about a respective axis, and wherein:

each agitator element comprises a first, free end and a second end, each agitator element has a shape which tapers towards the first end in a direction along the axis of rotation, the first and second agitator elements are cantilevered from opposing sides of a hub portion of the cleaner head at their respective second ends, and each agitator element is arranged such that when the cleaner head is engaged with the horizontal surface, the position of the axis at the first end of the agitator element is closer to the surface than the position of the axis at the second end of the agitator element, at least part of the upper portions at the second ends of the agitator elements are spaced apart from one another and, wherein at least part of the lower portions at the second ends of the agitator elements are touching one another.

2. The cleaner head of claim 1, wherein the lowermost portion of the external surface of each agitator element is parallel to the horizontal surface when the cleaner head is engaged with the horizontal surface.

3. The cleaner head of claim 1, further comprising a sole plate in which a suction opening is formed, wherein the lowermost portion of the external surface of each agitator element is parallel to the sole plate.

4. The cleaner head of claim 1, wherein the uppermost portions of the second ends of the agitator elements are spaced apart, and the lower portions of the second ends of the agitator elements are directly adjacent to each other.

5. The cleaner head of claim 4, wherein the lowermost portions of the second ends of the agitator elements are touching one another.

6. The cleaner head of claim 1, wherein the external surfaces of the agitator elements comprise a felt-like covering.

7. The cleaner head of claim 1, wherein the external surfaces of the agitator elements comprise upstanding helical strips of bristles.

8. The cleaner head of claim 1, further comprising a drive for driving rotation of the agitator elements.

9. The cleaner head of claim 8, wherein the drive comprises first and second motors, the first motor being arranged to drive rotation of the first agitator element, and the second motor being arranged to drive rotation of the second agitator element.

10. The cleaner head of claim 9, wherein each motor is disposed at least partially within the core of its respective agitator element.

11. The cleaner head of claim 9, wherein the first and second motors are arranged back-to-back and counter rotating, such that in use the first and second agitator elements rotate in the same direction.

12. The cleaner head of claim 9, wherein the drive further comprises first and second gears arranged to change the output speeds of the first and second motors respectively, the first and second gears being disposed within the cores of the first and second agitator elements respectively.

13. The cleaner head of claim 8, wherein the drive comprises a single motor arranged to drive rotation of both the first and second agitator elements via respective first and second transmissions.

14. A vacuum cleaner comprising the cleaner head of claim 1.

* * * * *